US008615176B2

(12) United States Patent
Koizumi

(10) Patent No.: US 8,615,176 B2
(45) Date of Patent: Dec. 24, 2013

(54) ELECTROPHOTOGRAPHIC IMAGE FORMING APPARATUS USING A PERIODIC WAVE AS A DEVELOPING BIAS

(75) Inventor: Kazuhisa Koizumi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 349 days.

(21) Appl. No.: 13/069,692

(22) Filed: Mar. 23, 2011

(65) Prior Publication Data

US 2011/0243592 A1 Oct. 6, 2011

(30) Foreign Application Priority Data

Mar. 31, 2010 (JP) ..... 2010-083405

(51) Int. Cl.
*G03G 15/06* (2006.01)
*G03G 15/00* (2006.01)

(52) U.S. Cl.
USPC ..... 399/55; 399/43

(58) Field of Classification Search
USPC ..... 399/43, 44, 55, 285
See application file for complete search history.

(56) References Cited

U.S. PATENT DOCUMENTS 5,659,840 A * 8/1997 Miyamoto et al. ..... 399/55
5,669,050 A * 9/1997 Sakemi et al. ..... 399/270
5,860,040 A * 1/1999 Shimizu et al. ..... 399/55
6,163,663 A * 12/2000 Shinohara et al. ..... 399/55
6,459,862 B1 10/2002 Sakemi et al.
7,515,840 B2 * 4/2009 Yamane ..... 399/44
7,890,029 B2 * 2/2011 Hamada ..... 399/270
8,135,295 B2 * 3/2012 Hamada ..... 399/55
8,311,429 B2 * 11/2012 Okumura ..... 399/55

FOREIGN PATENT DOCUMENTS

JP 08262851 A * 10/1996
JP 09311539 A * 12/1997

* cited by examiner

*Primary Examiner* — Robert Beatty
(74) *Attorney, Agent, or Firm* — Fitzpatrick, Cella, Harper & Scinto

(57) ABSTRACT

An image forming apparatus includes an image carrier, a developing unit that visualizes an electrostatic latent image formed on a surface of the image carrier, using a developing material, and a supply unit that supplies a periodic wave as a developing bias to the developing unit. A single period of the periodic wave is formed by a first time period in which a voltage in which a DC voltage and an AC voltage are superimposed is applied and a second time period in which only a DC voltage is applied. In addition, a count unit counts an amount of electrostatic latent images that have been formed in succession, and a control unit changes the duration of the second time period according to the amount of electrostatic latent images counted by the count unit without stopping image formation to continue the image formation.

8 Claims, 4 Drawing Sheets

ELECTROPHOTOGRAPHIC IMAGE FORMING APPARATUS USING A PERIODIC WAVE AS A DEVELOPING BIAS

BACKGROUND OF THE INVENTION

1. Field of the Invention

The present invention relates to an electrophotographic image forming apparatus using a periodic wave as a developing bias.

2. Description of the Related Art

With an electrophotographic image forming apparatus, a developing bias (blank pulse) having a wave formed by a pulse section and a pausing section (blank section) is applied to a developing device. Although a voltage in which an AC voltage is superimposed on a DC voltage is applied in the pulse section, in the blank section, the AC voltage is not superimposed and only the DC voltage is applied. It has been confirmed that the blank pulse is effective in improving image quality, and thus has been used in many instances (U.S. Pat. No. 6,459,862).

The blank pulse is advantageous in terms of the following three aspects.

1) In the pulse section, toner present between a photosensitive body and a developing device repeatedly adsorbs (a process of returning from the photosensitive body to the developing device) and discharges (a process of adhering to the photosensitive body from the developing device). This repetition of adsorption and discharge prevents toner whose developing performance is unstable from adhering to the photosensitive body, which leads to an improvement in image quality.

2) A potential difference between the surface of the developing device and that of the photosensitive body is constant at the peak of the amplitude in the pulse section. Therefore, the adsorption and the discharge are repeatedly executed in a stable manner, which leads to an improvement in image quality.

3) By including a blank section in the developing bias, a certain time period for discharging toner is secured. Accordingly, it is possible to readily stabilize developing performance, which is advantageous for improving image quality.

Incidentally, it becomes possible to readily generate a square wave having a good waveform by disposing a resistor on the secondary side of a boosting transformer for generating a developing bias. However, such a resistor causes loss of electric power (generation of heat). Particularly when images are formed in succession, the temperature rises greatly due to the resistor. In view of this, the following methods are possible for mitigating such rising of the temperature.

i) A cooling mechanism such as a fan for cooling a developing bias output circuit is disposed.

ii) Continuous image formation is interrupted, thereby suppressing temperature rising in a developing bias supply circuit.

iii) The duration of the blank section at the time of temperature rising is set to be longer than the duration of the blank section during normal image formation, thereby suppressing temperature rising in the developing bias supply circuit.

However, employing a cooling fan not only invites an increase in cost, but also makes it difficult to reduce the size of the image forming apparatus. Also, when continuous image formation is interrupted, the downtime (waiting period in which image formation cannot be performed) of the image forming apparatus increases. In other words, image productivity and user convenience will be reduced. The method in which the duration of the blank section is increased is advantageous in that it has little effect on the potential amount, toner carriage amount, or the like, of the photosensitive body, on which the quality of output images depends. However, as the duration of the blank section becomes longer, the development period becomes longer. As a result, "fogging" (the discharge of toner particles having unstable developing performance) often occurs, which reduces the service life of an image forming unit.

SUMMARY OF THE INVENTION

In view of the above, the present invention has a feature solving at least one of the above-described or other issues. For example, the present invention has a feature of, while suppressing temperature rising in the developing bias supply circuit, improving the service life of the image forming unit compared with existing image forming units. Note that other issues will be understood through the entire description.

The present invention provides an image forming apparatus that includes an image carrier, a developing unit, a supply unit and a control unit. The developing unit visualizes an electrostatic latent image formed on a surface of the image carrier, using a developing material. The supply unit supplies a periodic wave as a developing bias to the developing unit, a single period of the periodic wave being formed by a first time period in which a voltage in which a DC voltage and an AC voltage are superimposed is applied and a second time period in which only a DC voltage is applied. The control unit may change the duration of the second time period according to the amount of electrostatic latent images that have been formed in succession.

Alternatively, the control unit may change the duration of the second time period in relation to rising of an internal temperature of the image forming apparatus.

Further features of the present invention will become apparent from the following description of exemplary embodiments (with reference to the attached drawings).

DESCRIPTION OF THE EMBODIMENTS

An embodiment of the present invention is described below. The embodiment will be useful for understanding various concepts of the present invention, such as superordinate concepts, intermediate concepts, and subordinate concepts. Note that the technical scope of the present invention is defined by the claims, and is not limited by the embodiment described below.

Figure 1:
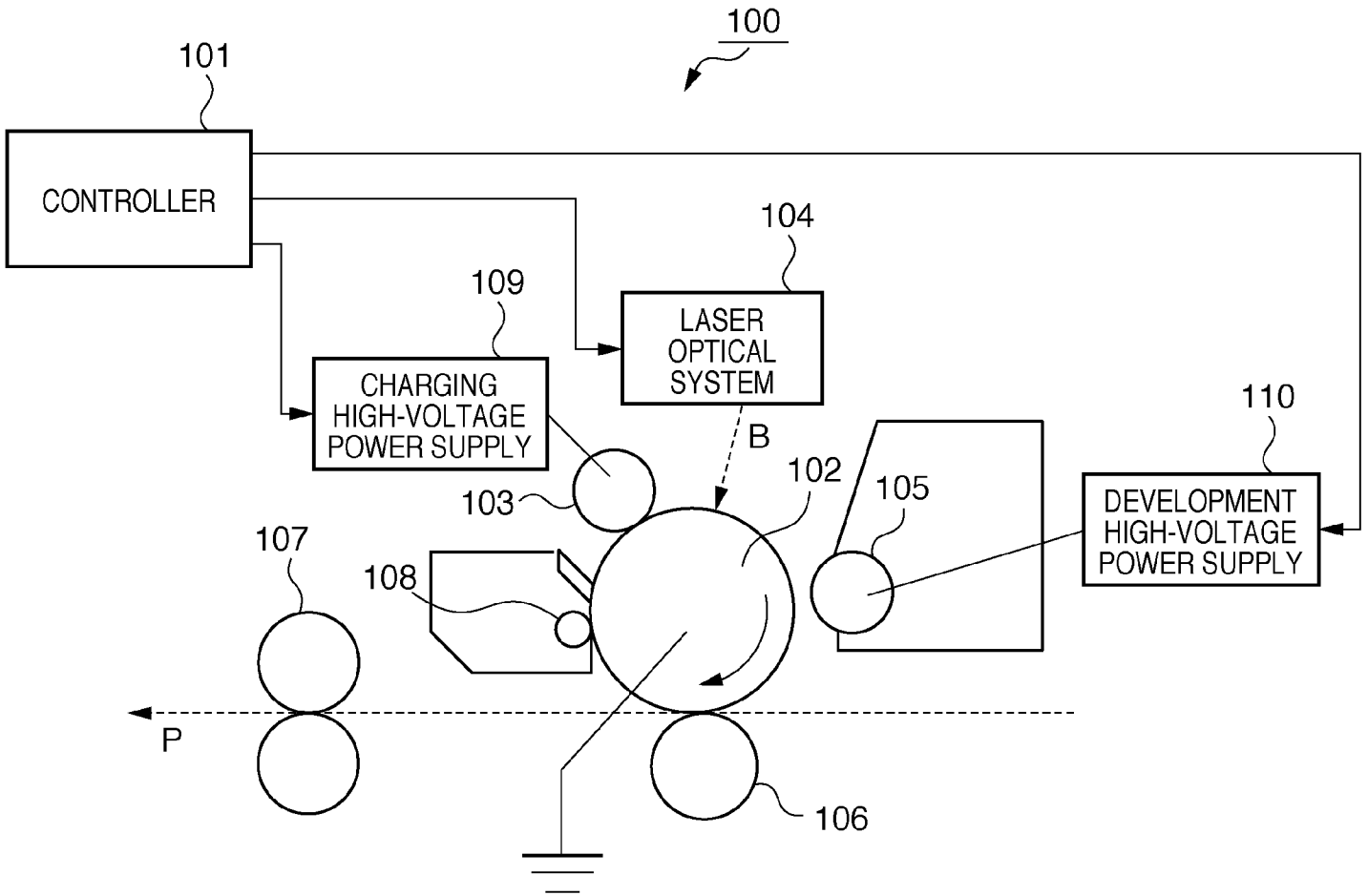
FIG. 1 is a schematic cross-sectional view of an image forming apparatus.

FIG. 1 shows an electrophotographic image forming apparatus 100. A controller 101 is a control unit for performing control of an electrophotographic process sequence. A photosensitive drum 102 is an image carrier for carrying an electrostatic latent image or a developing material image (toner image). A photo semiconductor layer whose electrical characteristics change by irradiation with light is formed on the surface of the photosensitive drum 102.

The photosensitive drum 102 rotates at a constant speed during image forming operation. The electrophotographic process sequence is executed in the following order.

1) Charging process: a charging high-voltage power supply 109 applies a high-voltage output (charging bias) to a charging device 103 based on a control signal from the controller 101. Note that the shaft of the photosensitive drum 102 is grounded. Consequently, the charging device 103 evenly charges the photo semiconductor layer of the photosensitive drum 102.

2) Laser exposure process: a laser optical system 104 irradiates the photosensitive drum 102 with light according to an image pattern (electrostatic latent image) (dashed line B).

3) Development process: a development high-voltage power supply 110 applies a high-voltage output (developing bias) to a developing device 105 based on a control signal from the controller 101. The developing device 105 thus causes toner serving as a developing material to adhere to the electrostatic latent image on the photosensitive drum 102, thereby visualizing the electrostatic latent image as a toner image. In this manner, the developing device 105 functions as a developing unit that visualizes an electrostatic latent image formed on the surface of the image carrier with the use of a developing material.

4) Transfer process: a transfer roller 106 transfers the developing material image from the photosensitive drum 102 onto a recording material that has been transported (hereinafter referred to as a "recording sheet", which is transported in the direction of a dashed-line P).

5) Fixing process: a fixing device 107 applies heat and pressure to the recording sheet, thereby fixing the toner image onto the recording sheet. Thereafter, the recording sheet is discharged from the image forming apparatus 100.

6) Cleaning process: a cleaner 108 removes toner that has not been transferred onto the recording sheet and remains on the photosensitive drum 102.

Figure 2:
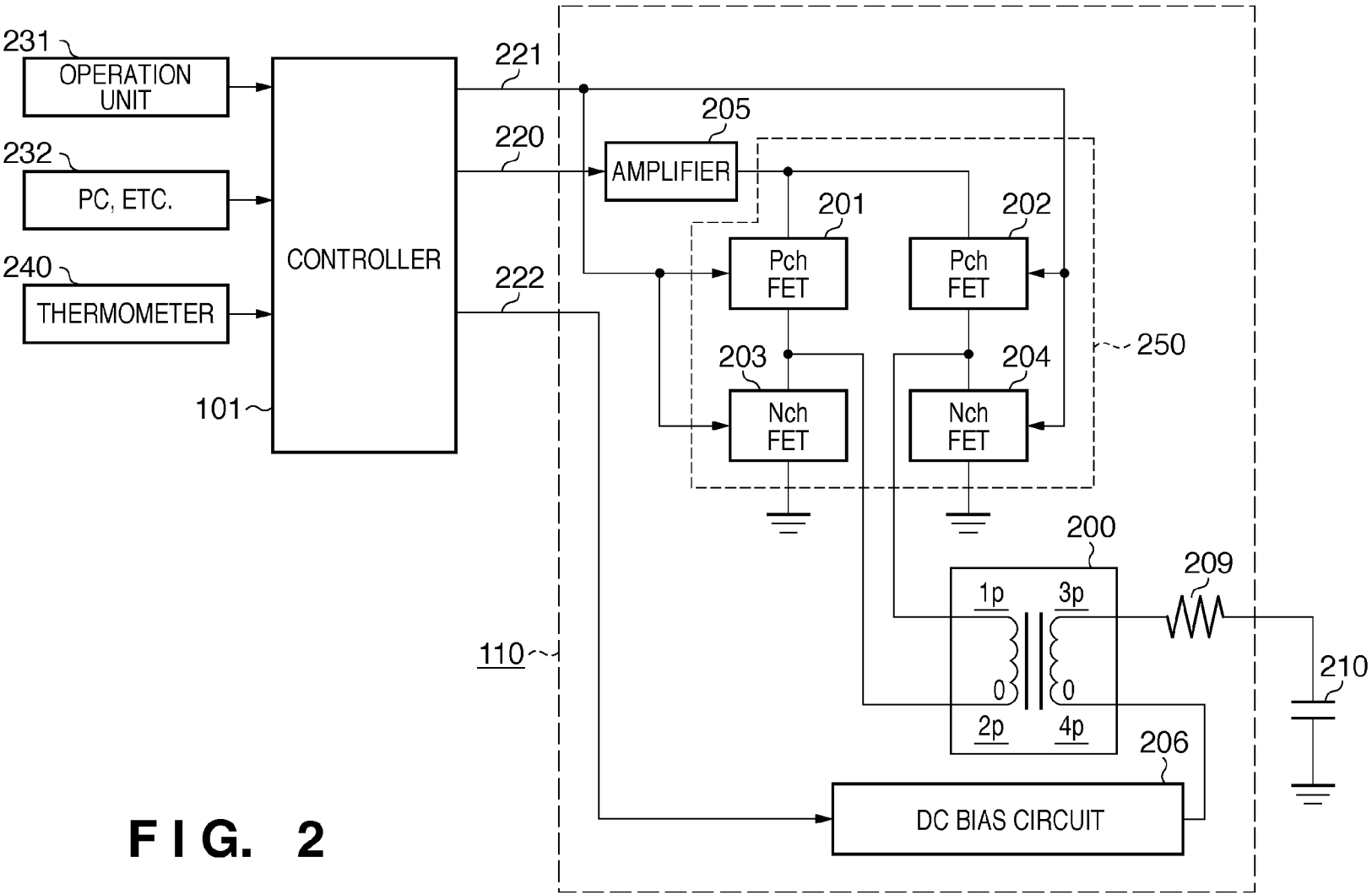
FIG. 2 is a block diagram illustrating a development high-voltage power supply.

A configuration example and operations of the development high-voltage power supply 110 will be described below with reference to FIG. 2. An H bridge circuit 250 is connected to a primary side of a boosting transformer 200 (between 1*p* and 2*p*). The H bridge circuit 250 applies an AC voltage to the primary side of the boosting transformer 200 based on an AC voltage amplitude control signal output from the controller 101 and a timing signal for defining switching timing on the primary side of the boosting transformer 200. The H bridge circuit 250 is configured by bridge-connecting a plurality of switching elements. For example, the H bridge circuit 250 shown in FIG. 2 is configured from Pch FETs 201 and 202 and Nch FETs 203 and 204. The controller 101 outputs an AC amplitude control signal 220, which is amplified by an amplifier 205 and supplied to the H bridge circuit 250. The AC amplitude control signal 220 is a signal for controlling the amplitude of the drive voltage of the H bridge circuit 250. The controller 101 outputs a blank pulse generation signal 221, which is supplied to the H bridge circuit 250. The H bridge circuit 250 performs switching operation based on the blank pulse generation signal 221, thereby generating a blank pulse (in particular, a pulse section) serving as an AC voltage.

One end of a resistor 209 is connected to a first terminal 3*p* on a secondary side (3*p*-4*p*) of the boosting transformer 200, and a DC bias circuit 206 is connected to a second terminal 4*p*. A capacitive load 210 formed between the surface of the photosensitive drum 102 and that of the developing device 105 is connected to the other end of the resistor 209. Specifically, the resistor 209 is inserted in series between the first terminal 3*p* and the capacitive load 210. The DC bias circuit 206 generates a DC voltage based on a DC voltage control signal 222 supplied from the controller 101, and applies the generated DC voltage to the second terminal 4*p*. In this manner, a developing bias in which an AC voltage and a DC voltage are superimposed is generated.

A thermometer 240 for measuring the temperature of the development high-voltage power supply 110 or the resistor 209 is connected to the controller 101.

Figure 3A:
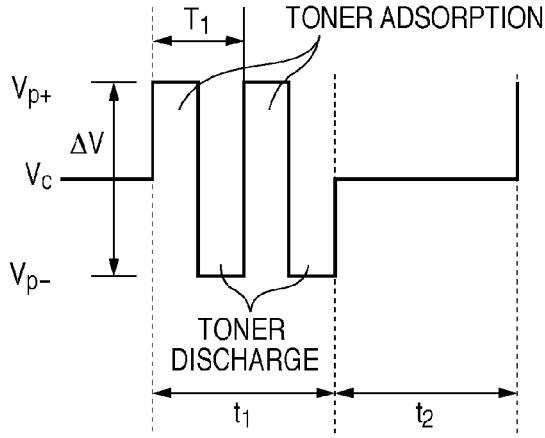
FIG. 3A is a diagram conceptually illustrating a blank pulse.

The blank pulse supplied by the development high-voltage power supply 110 will be described below with reference to FIG. 3A. Note that the horizontal axis indicates time (in an arbitrary unit), and the vertical axis indicates voltage (in an arbitrary unit). The blank pulse is a periodic wave, a single period of which is formed by a first time period $t_1$ in which a voltage in which a DC voltage and an AC voltage are superimposed is applied, and a second time period $t_2$ in which only a DC voltage is applied. A signal wave in the first time period $t_1$ is called a pulse section, and the signal wave in the second time period $t_2$ is called a blank section. The amplitude in the pulse section is $\Delta V$, and the period of the square wave forming the pulse section is $T_1$. $V_c$ indicates a DC voltage. As shown in FIG. 3A, in the pulse section, since an AC voltage is superimposed on the DC voltage $V_c$, the amplitude varies between a first peak voltage $V_p+$ and a second peak voltage $V_p-$. That is, an AC voltage is a voltage in which the first peak voltage $V_p+$ that acts such that the developing material is pulled back from the photosensitive drum 102 to the developing device 105 and the second peak voltage $V_p-$ that acts such that the developing material is discharged from the developing device 105 to the photosensitive drum 102 are alternately repeated. In this manner, the development high-voltage power supply 110 functions as a supply unit that supplies a periodic wave as a developing bias to the developing unit, a single period of the periodic wave being formed by the first time period in which a voltage in which a DC voltage and an AC voltage are superimposed is applied and the second time period in which only a DC voltage is applied.

Note that the resistor 209 is disposed on the secondary side of the boosting transformer 200 in order to fix a constant potential difference between the surface potential of the photosensitive drum 102 and the surface potential of the developing device 105 at the peak of the AC voltage. Thus, overshoot or undershoot in the wave in the pulse section can be suppressed. Energy suppressed by the resistor 209 results in electric power loss, that is, is discharged as heat. Therefore, the temperature of the resistor 209 greatly rises when an AC voltage forming a part of the developing bias is applied, namely, during the first time period $t_1$. In other words, heat is not generated in the resistor 209 while the AC voltage is not applied to developing device 105. Consequently, in the second time period $t_2$, almost no temperature rising due to the resistor 209 occurs in the development high-voltage power supply 110. Therefore, in the present invention, improvement in developing performance and suppression of temperature rising are both achieved by adjusting the first time period $t_1$ in which an AC voltage is applied and the second time period $t_2$ in which an AC voltage is not applied.

Figure 3B:
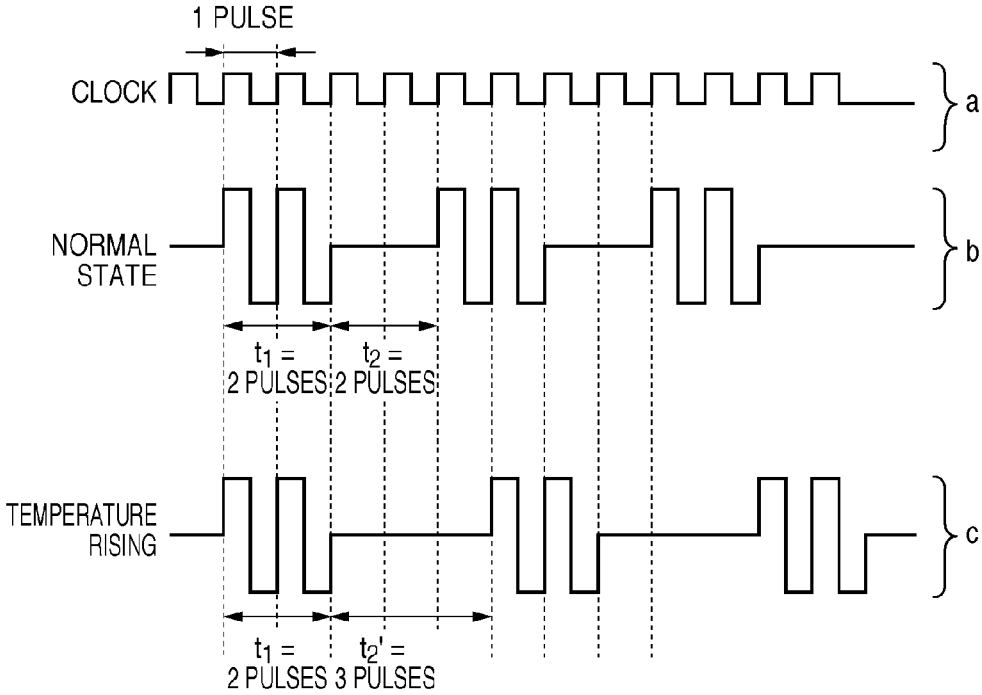
FIG. 3B is diagram illustrating adjustment of the duration of the blank pulse.

In FIG. 3B, (a) illustrates a basic clock for generating an AC signal (e.g., frequency is approximately several kHz to 20 kHz). The first time period $t_1$, in which an AC voltage is applied, and the second time period $t_2$, in which an AC voltage is not applied, are set using one pulse of the basic clock as a unit. In FIG. 3B, (b) illustrates a blank pulse A applied in the image forming apparatus 100 in a normal state. The duration of the first time period $t_1$ in which an AC voltage is applied corresponds to two pulses of the basic clock. The duration of the second time period $t_2$ in which an AC voltage is not applied also corresponds to two pulses of the basic clock. These values are determined when the image forming apparatus 100 is shipped from the factory. In FIG. 3B, (c) illustrates a blank pulse B applied at the time of temperature rising. Although the duration of the first time period $t_1$ corresponds to two pulses of the basic clock, that of a second time period $t_2'$ corresponds to three pulses of the basic clock. This duration corresponds to 1.5 times the duration in a normal state. The time period in which heat is not generated in the resistor 209 is increased by setting the second time period $t_2'$ applied at the time of temperature rising to be longer than the second time period $t_2$ applied in a normal state, thereby making it possible to suppress rising of the temperature due to the heat generated in the resistor 209. In addition, the service life of the image forming unit can be improved. In the present embodiment, the duration of the second time period is adjusted depending on the number of sheets of images that the controller 101 has formed in succession (or, rising of the temperature in the image forming apparatus 100 due to the resistor 209). Specifically, the controller 101 functions as a time period control unit that changes the duration of the second time period depending on the number of sheets of images (the number/amount of electrostatic latent images) that have been formed in succession. Note that the number of sheets of images that have been formed in succession may be the number of images actually printed on recording media, or may be the amount of electrostatic latent images formed on the image carrier. This is because generally, these numbers match each other. In the following description, for the sake of convenience, it is assumed that the number of sheets of images that have been formed in succession is counted.

Figure 4:
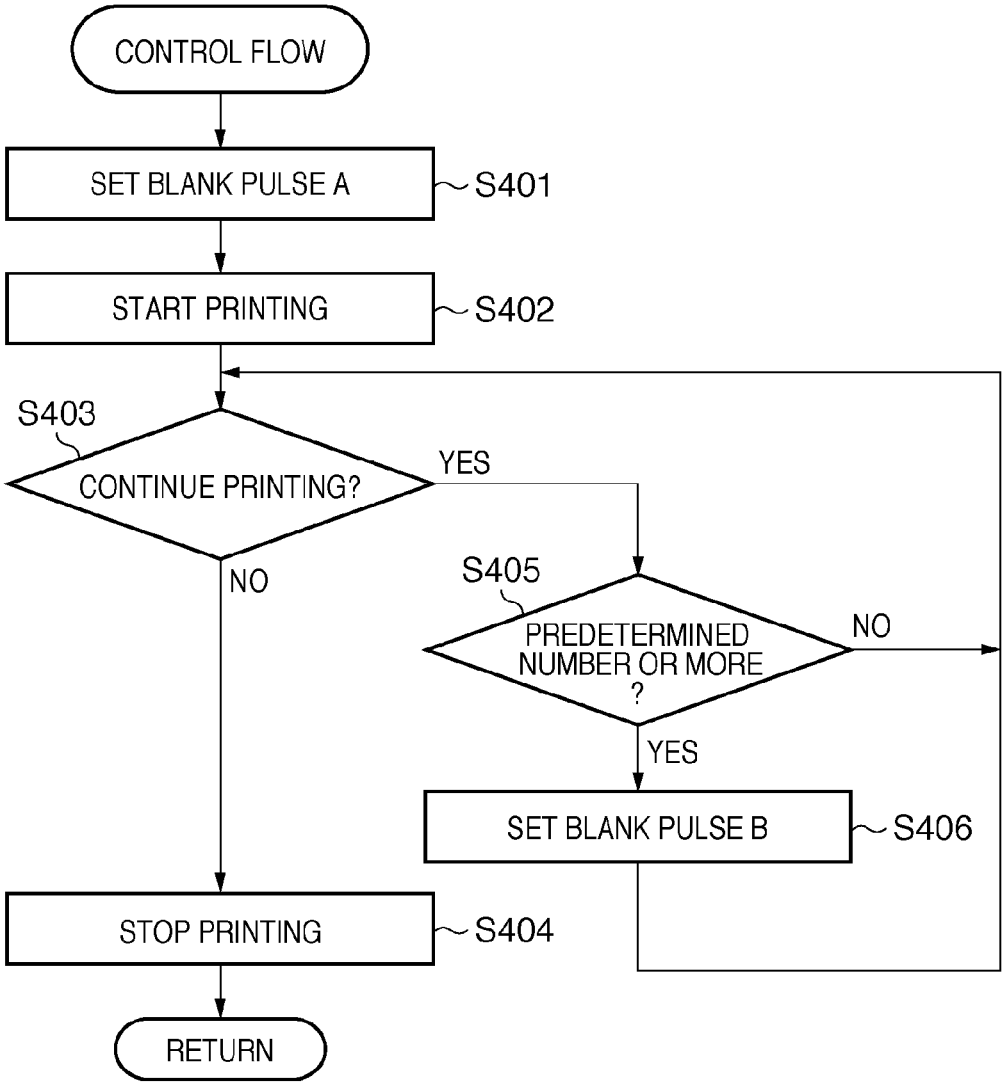
FIG. 4 is a flowchart illustrating control of the blank pulse during image forming processing.

The operation of the present embodiment will be described with reference to the control flowchart shown in FIG. 4. The flowchart shown in FIG. 4 is executed by the controller 101. In step S401, the controller 101 performs initial settings for outputting the blank pulse A as a developing bias with which an optimal developing performance is achieved. Accordingly, the AC amplitude control signal 220, blank pulse generation signal 221 and DC voltage control signal 222 for outputting the blank pulse A are output from the controller 101.

In step S402, upon receiving a request to start an image forming operation (hereinafter referred to as "printing") from an operation unit 231 or a PC 232, the controller 101 starts the printing operation. For example, the controller 101 applies a blank pulse A developing bias to the developing device 105 to execute printing, and starts counting the number of the printed sheets. The controller 101 functions as a count unit that counts the number of sheets of images that are formed in succession.

In step S403, the controller 101 determines whether the printing operation is to be continued or stopped. This determination is executed by, for example, comparing the number of print sheets designated in a corresponding print job with the number of completed printed sheets. The controller 101 functions as a determination unit that determines whether the number of sheets of images counted by the count unit is a predetermined number (e.g., 200 sheets) or more. When printing is completed for the full number of sheets requested by the user, the processing proceeds to step S404, where the controller 101 stops printing. If printing is not completed for the full number of sheets, the processing proceeds to step S405, where printing is continued. Note that also when the image forming apparatus 100 is in a condition in which it is impossible to continue the printing operation (e.g., an error in the apparatus, paper jam, or cancellation of printing request by the user), the controller 101 proceeds to step S404, and stops printing.

In step S405, the controller 101 determines whether the number of sheets of images that have been formed in succession (count value) is a predetermined number (e.g., 200 sheets (A4 size) in succession) or more. When the count value is less than the predetermined number, it is presumed that the temperature has not yet risen greatly, and thus the processing returns to step S403 to continue printing. In contrast, when the count value is the predetermined number or more, it is presumed that temperature rising should be suppressed, and thus the processing proceeds to step S406. In step S406, the controller 101 sets application conditions of the developing bias so as to output the blank pulse B. When the application conditions of the developing bias are changed, the blank pulse generation signal 221 is also changed. As a result, switching timings of the Pch FETs 201 and 202 and Nch FETs 203 and 204 are changed, and consequently the blank pulse A is changed to the blank pulse B. In this manner, the controller 101 increases the duration of the second time period. The controller 101 functions as a time period control unit that, when the number of sheets of images counted by the count unit has reached or exceeded a predetermined number, adjusts the duration of the second time period to be longer than the duration of the second time period that was applied to a supply unit before the number of sheets of images counted by the count unit reached or exceeded the predetermined number. In the example shown in FIG. 3B, the controller 101 sets $t_2'$ to have a duration that is 1.5 times that of $t_2$. The multiplying factor used in this adjustment differs depending on the apparatus models, and therefore appropriate multiplying factors may be obtained by tests or simulation. Thereafter, processing returns to step S403, and the controller 101 continues the printing operation while suppressing temperature rising. Note that when the printing operation is stopped in step S404, the controller 101 restores the application conditions of the developing bias to those for outputting the blank pulse A. This is because when the printing operation is stopped, application of the developing bias is stopped and accordingly the temperature in the resistor 209 drops.

As described above, in the present embodiment, the duration of the second time period in which an AC voltage is not superimposed and only a DC voltage is applied is set according to the number of sheets of images that have been formed in succession. In this manner, while suppressing temperature rising in the developing bias supply circuit, the service life of the image forming unit is improved compared with conventional image forming units. In addition, since temperature rising is suppressed, the downtime of the image forming apparatus can be reduced.

In the present embodiment, although the blank pulse is selected from two pulses, namely, the blank pulse A and the blank pulse B, this is the simplest example of the present invention. For example, three or more blank pulses that respectively include blank sections having mutually different durations may be switched depending on the extent of rising of the temperature in the resistor 209. The extent of rising of the temperature is approximately proportionate to the number of sheets of images that have been formed in succession. Accordingly, the controller 101 may gradually increase the duration of the second time period $t_2$ in proportion to the number of sheets of images that have been formed in succession. Of course, when the number of sheets of images (the amount of electrostatic latent images) that have been formed in succession is less than a predetermined number, there is no need to increase the duration of the second time period $t_2$.

With respect to the number of sheets of images and the amount of electrostatic latent images, the number designated by the operator in each print job may be employed as is. In addition, the number of sheets of images (the amount of electrostatic latent images) that have been formed in succession may be the number of images or electrostatic latent images formed within a fixed time period. When a plurality of operators has input mutually different print jobs, the count number may be reset to zero between a preceding print job and a following print job. However, when a plurality of print jobs is input in succession in a short period of time, it is possible that the cooling of the interior will be too slow. Therefore, in the case of a plurality of print jobs input within a prescribed time period or input in succession, such print jobs may be regarded substantially as a single print job. That is, the controller 101 may add together the numbers of sheets of images (the numbers of electrostatic latent images) that have been formed in succession for a plurality of print jobs.

Incidentally, in the present embodiment, although the controller 101 counts the number of sheets of images formed in succession, the duration of the second time period $t_2$ may be increased in relation to rising of the internal temperature of the image forming apparatus (temperature of the resistor 209). In such a case, the controller 101 functions as a time period control unit that increases the duration of the second time period in relation to rising of the internal temperature of the image forming apparatus. In addition, the controller 101 obtains temperature data from the thermometer 240 that measures the internal temperature of the image forming apparatus (temperature of the development high-voltage power supply 110 or resistor 209), and compares the obtained temperature data with a prescribed threshold. In other words, when the temperature is the threshold or higher, the blank pulse B is selected, and when the temperature is lower than the threshold, the blank pulse A is selected. By performing the above-described control, the downtime of the image forming apparatus is reduced in a successive printing operation.

Although installed in various types of environment, an image forming apparatus is most commonly installed in an office environment. In an office environment, a printing operation for printing a small number of sheets is often executed. That is, empirically, it is typical that in a single print operation, one to several electrostatic latent images are formed, and it is rare that a large amount of electrostatic latent images are formed in succession. Therefore, by setting a default value of the second time period $t_2$ serving as the duration of the blank section to a smaller value, shortening of the service life of an image forming unit in the image forming apparatus 100 can be mitigated.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-083405, filed Mar. 31, 2010 which is hereby incorporated by reference herein in its entirety.

What is claimed is:

1. An image forming apparatus comprising:

an image carrier;

a developing unit that visualizes an electrostatic latent image formed on a surface of the image carrier, using a developing material;

a supply unit that supplies a periodic wave as a developing bias to the developing unit, a single period of the periodic wave being formed by a first time period in which a voltage in which a DC voltage and an AC voltage are superimposed is applied and a second time period in which only a DC voltage is applied;

a count unit that counts an amount of electrostatic latent images that have been formed in succession; and a control unit that changes the duration of the second time period according to the amount of electrostatic latent images counted by the count unit without stopping image formation to continue the image formation.

2. The image forming apparatus according to claim 1, wherein in a case where the amount of the electrostatic latent images counted by the count unit is a predetermined amount or more, the control unit sets the duration of the second time period to be longer than the duration of the second time period that was applied to the supply unit before the amount of the electrostatic latent images counted by the count unit reached or exceeded the predetermined amount.

3. The image forming apparatus according to claim 1, wherein the control unit gradually increases the duration of the second time period in proportion to the amount of electrostatic latent images that have been formed in succession.

4. The image forming apparatus according to claim 1, wherein the AC voltage is a voltage in which a first peak voltage that acts so as to pull back a developing material from the image carrier to the developing unit and a second peak voltage that acts so as to discharge the developing material from the developing unit to the image carrier are alternately repeated.

5. The image forming apparatus according to claim 1, wherein the supply unit comprises:

a boosting transformer;

a bridge circuit that receives an input of an AC voltage amplitude control signal output from the control unit and an input of a timing signal for defining switching timing and outputs an AC voltage, and applies the AC voltage to a primary side of the boosting transformer;

a DC bias circuit that generates a DC voltage based on a DC voltage control signal output from the control unit and applies the DC voltage to a second terminal on a secondary side of the boosting transformer; and a resistor connected in series to a first terminal of a winding wire on the secondary side of the boosting transformer, and the resistor is connected in series to a capacitive load formed between the surface of the image carrier and a surface of the developing unit.

6. The image forming apparatus according to claim 2, wherein the count unit is further configured to reset the counted amount upon a print job being finished and to continue counting the amount upon a succeeding print job existing at a preceding print job being finished.

7. The image forming apparatus according to claim 6, wherein the count unit is further configured to continue counting the amount upon the succeeding print job existing at the preceding print job being finished to sum the counted amount of preceding print job and the counted amount of the succeeding print job.

8. The image forming apparatus according to claim 1, wherein the count unit is further configured to increase the duration of the second time period to cool down the supply unit.

* * * * *